United States Patent [19]

Suzuki et al.

[11] Patent Number: 4,951,173

[45] Date of Patent: Aug. 21, 1990

[54] CREEPING DISCHARGE TYPE IGNITER PLUG

[75] Inventors: Takahiro Suzuki; Yuki Izuoka; Noboru Aoki, all of Nagoya, Japan

[73] Assignee: NGK Spark Plug Co., Ltd., Nagoya, Japan

[21] Appl. No.: 280,837

[22] Filed: Dec. 7, 1988

[30] Foreign Application Priority Data

Dec. 18, 1987 [JP] Japan ..... 62-322565

[51] Int. Cl.[5] ..... F23Q 3/00

[52] U.S. Cl. ..... 361/253; 313/131 A

[58] Field of Search ..... 313/131 A; 361/247, 361/253, 255

[56] References Cited

U.S. PATENT DOCUMENTS

| | | | |
|---|---|---|---|
| 3,883,762 | 5/1975 | Harris et al. | 313/131 A |
| 4,144,474 | 3/1979 | Nishio et al. | 313/131 A |
| 4,264,844 | 4/1981 | Axe et al. | 313/131 A |
| 4,337,408 | 6/1982 | Sone et al. | 313/131 A |
| 4,419,601 | 12/1983 | Hamai et al. | 313/131 A |
| 4,814,664 | 3/1989 | Rothenbuhler | 313/131 A |

*Primary Examiner*—A. D. Pellinen
*Assistant Examiner*—Jeffrey A. Gaffin
*Attorney, Agent, or Firm*—Cooper & Dunham

[57] ABSTRACT

This invention provides a creeping discharge type igniter plug, having a center electrode concentrically located within the center bore of the insulator. Near the lower portion of the center electrode is an annular space (6), formed between an outer surface of the center electrode and an inner surface of the semi-conductor ring (4). At the annular space (6), a lateral distance between the outer surface of the center electrode (2) and the inner surface of the semi-conductor ring (4), progressively decreases toward a lower end of the semi-conductor ring (4) thus, making it possible to maintain the least electrical resistance at a creeping discharge path defined from a lower end surface (3*a*) of the ground electrode (3) to a lower end surface (2*a*) of the center electrode (2) via a lower end surface (4*b*) of the semi-conductor ring (4).

6 Claims, 4 Drawing Sheets

CREEPING DISCHARGE TYPE IGNITER PLUG

BACKGROUND OF THE INVENTION

1. Field of the Invention

This invention relates to a low voltage creeping discharge igniter plug having a semi-conductor ring to form a creeping discharge surface, and particularly concerns to an igniter plug in use for a gas or turbine engine of aircraft.

2. Description of the Prior Art

In an igniter plug of this kind, a semi-conductor ring is placed between both end portions of a center electrode and an annular ground electrode, so that a discharge occurs through an end surface of the semi-conductor ring at a relatively low voltage.

For this discharge constantly to occur, it is necessary to diminish a resistance between the electrodes at their lower end so as to concentrate a discharge energy thereupon.

By way of illustration, as shown in FIG. 7, a semi-conductor ring 13 which is connected in integral with a tubular insulator 14 at their lower portion, is provided between a center electrode 12 and a ground electrode 11*b*. The ground electrode 11*b* provides an inner tapered surface 11*a* at the lower portion in a manner that a distance between an outer surface of the center electrode 12 and the tapered surface 11*a* progressively increases as being successively away from the ends of the electrodes 11*b*, 12. The least distance is obtained at the ends of the electrodes 11*b*, 12, so that a discharge occurs along an end surface 13*a* of the semi-conductor ring 13. It is noted that a very minute gap is provided between the center electrode 12 and the ground electrode 11*b* as a clearance although not shown.

In this construction, an atmosphere near the end surface 13*a* increases an electrical resistance, failing to occur the discharge along the end surface 13*a* when used at a high atmospheric condition. A voltage impressed between the electrodes 11*b*, 12 causes to discharge within the semi-conductor ring 13, fearing to crack the semi-conductor ring 13 so as to result in a breakdown of insulation.

Therefore, it is a primary object of this invention to provide a low voltage creeping discharge igniter plug which is capable of maintaining a discharge to occur along an end surface of a semi-conductor ring without breakdown of the semi-conductor, leading to a long service life.

According to this invention, there is provided a low voltage creeping discharge igniter plug comprising; an outer annular metallic shell having an annular ground electrode connected to a lower end thereof; a tubular insulator concentrically placed into the metallic shell and having the semi-conductor ring connected to a lower end of the insulator; a center electrode longitudinally positioned within an inner side of the insulator and a lower end of the center electrode extending through the semi-conductor ring; the semi-conductor ring forming a creeping discharge surface at the lower end when a certain magnitude of voltage is applied between the ground electrode and the center electrode; an annular space provided between an inner surface of the semi-conductor ring and an outer surface of the center electrode, a distance therebetween progressively increasing as being away from the creeping discharge surface.

Other objects and advantages of this invention will be apparent from the following description, reference being made to the accompanying drawings where-in preferred embodiments of this invention are shown.

DETAILED DESCRIPTION OF THE INVENTION

Figure 1:
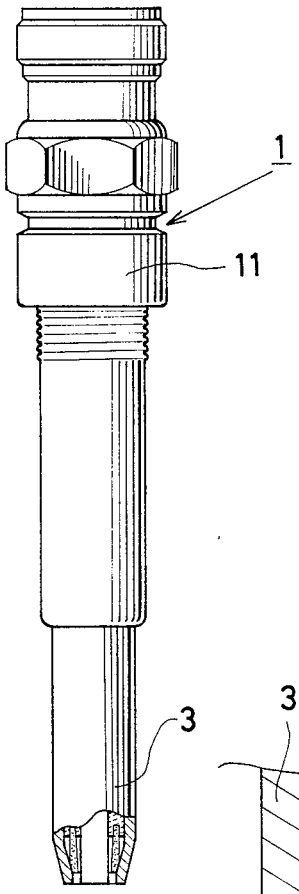
FIG. 1 is a plan view of igniter plug but partly sectioned.
Figure 2:
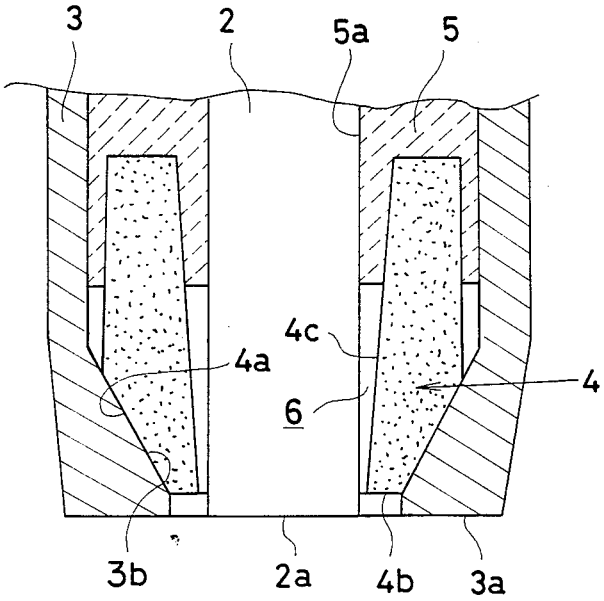
FIG. 2 is a partly enlarged longitudinal view of a main section.

In reference with FIGS. 1 and 2 of the drawings, an outer annular shell 11 has an annular ground electrode 3 connected straight to a lower end thereof. The ground electrode 3 is made of a tungsten-based alloy such as a tungsten-copper-nickel alloy.

A tubular insulator 5, which is made of glass, is concentrically placed within the ground electrode 3. The insulator 5 has a semi-conductor ring 4 integrally connected to a lower end thereof to be somewhat short of being flush with the lower end of the ground electrode 3.

Within a centerbore 5*a* of the insulator 5, is a center electrode 2 concentrically located an end of which extends through the semi-conductor ring 4 to be in flush with the lower end of the ground electrode 3.

The center electrode 2 is made of a spark-corrosion resistant tungsten-based alloy.

In this instance, the ground electrode 3 has a tapered inner surface 3*b* at the lower end portion to be tapered off at an end surface 3*a*. The least distance between the tapered inner surface 3*b* and an outer surface of the center electrode 2 is obtained at the end surface 3*a* and an end surface 2*a* of the center electrode 2. A high voltage impressed between the electrode 2, 3 causes a discharge to readily occur along the end surfaces 2*a* and 3*a*.

The semi-conductor ring 4 is made of sintered mixture of alumina ($Al_2O_3$) and silicon carbide (SiC) by means of hot press procedure. The mixing rate of alumina and silicon carbide is in turn 45% to 55% according to this embodiment. The ring 4 has a tapered outer surface 4*a* in good fitting relationship with the tapered inner surface 3*b* of the ground electrode. The lower end of the ring 4 somewhat retracts from the end surfaces 2*a* and 3*a* to form a creeping surface end 4*b*. The ring 4 further has a tapered inner surface 4*c* to form an annular space 6 between the ring 4 and the center electrode 2. The distance between the tapered inner surface 4*c* and an outer surface progressively increases as successively being away from the creeping surface end 4*b*. The annular space 6 determines its least width to be 0.03 mm at the creeping surface end 4*b*, and its greatest width to be 0.3 mm at the most remote portion from the creeping surface end 4*b*. It is noted that the width of the annular space 6 preferably may be 0.01 mm at the least portion, and 1.0 mm at the greatest portion.

The annular space 6, which is provided independent of the clearance of the prior art, acts as an air gap left as a blank by not completely filling the glass insulator 5 from the lower end of the inversed plug 1. This is achieved by controlling the temperature of the glass 5.

With the structure of the above, an electrical resistance between the electrodes 2 and 3 is equivalent to a resultant value regarding to that of the air gap and the ring 4. The resultant value progressively increases as successively being away from the creeping surface end 4*b*. The least value of the electrical resistance is obtained between the end surfaces 3*a* and 2*a*.

Even when an atmosphere near the end surface 4*b* increases an electrical resistance with the increase of the atmospheric pressure, a discharge always occurs along the end surface 4*b*, thus preventing the discharge from occurring at an inside of the semi-conductor rIng 4. ThIs enables to obviate a risk of occurring cracks in the semi-conductor ring 4 to contribute to a long service life with a relatively simple construction.

Figure 3:
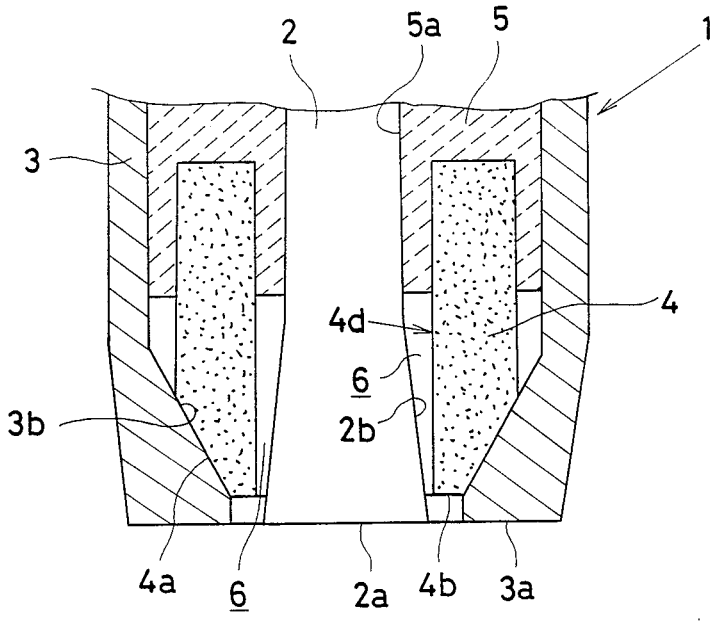
FIG. 3 is a view similar to FIG. 2 according to other embodiment of this invention.

Another embodiment of the invention is shown in FIG. 3 in which like references designate like numerals of the precedent embodiment.

In the embodiment of FIG. 3, the center electrode 2 has a tapered outer surface 2*b* to be flared up at the end surface 2*a*.

In the meantime, the semi-conductor ring 4 maintains its inner diameter constant all through a longitudinal dimension as seen by denotation 4*d*.

As a result, the least electrical resistance of the air gap 6 is obtained at the side of the end surface 4*b*, so that a discharge always occurs along the end surface 4*b* in a manner identical to that of the precedent embodiment.

Figure 4:
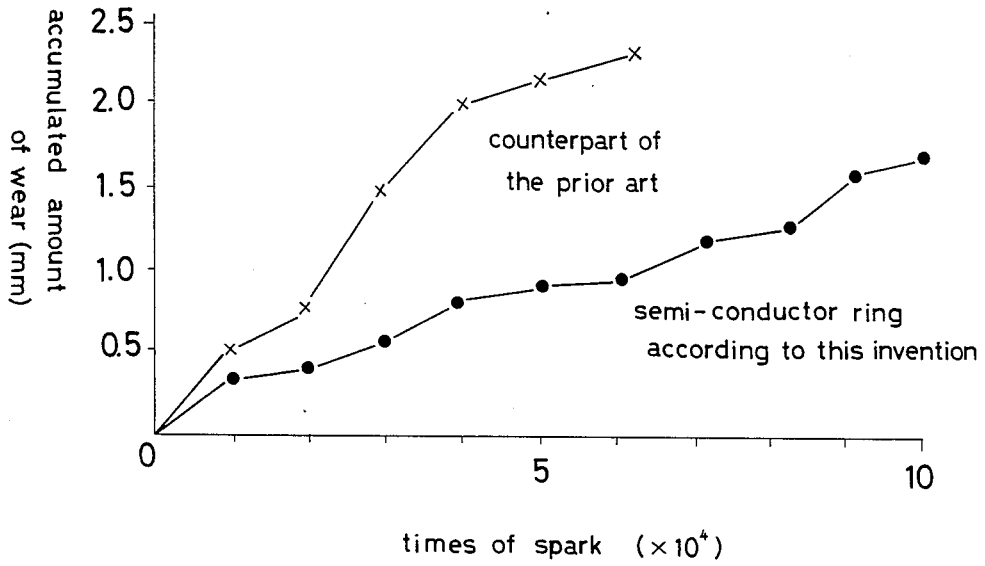
FIG. 4 is a graph showing a relationship between times of spark and an amount of wear [mm]

FIG. 4 shows a graph between an amount of accumulated wear [mm] of the semi-conductor and times of spark when a spark test is conducted with the temperature as 20 degrees centigrade, pressure 25kg/cm$^2$, discharge energy 4 joule.

Figure 7:
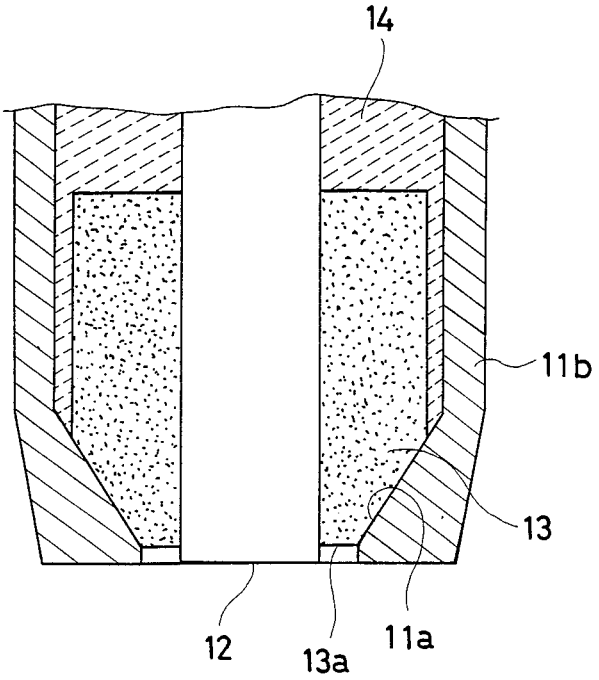
PRIOR ART Fig. 7
FIG. 7 is a sectional view of a main part according to a prior art.

The dotted spot marks are labeled for the igniter plug of FIG. 3, while crisscross marks being for the prior counterpart of FIG. 7. As understood by comparison with the crisscross and the dotted spot marks, the amount of wear according to the semi-conductor ring 4 decreases more than approximately half of that of the prior counterpart, and significantly enhancing a service life.

Figure 5:
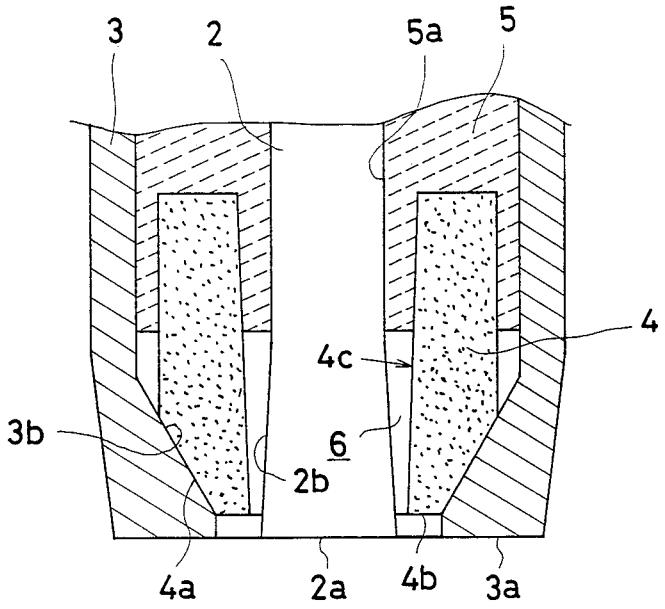
FIGS. 5 and 6 are view similar to FIG. 2 according to other modified forms.

It is noted that the semi-conductor ring 4 has the tapered inner surface 4*c* in the condition of FIG. 3 as seen at a modified form in FIG. 5.

Figure 6:
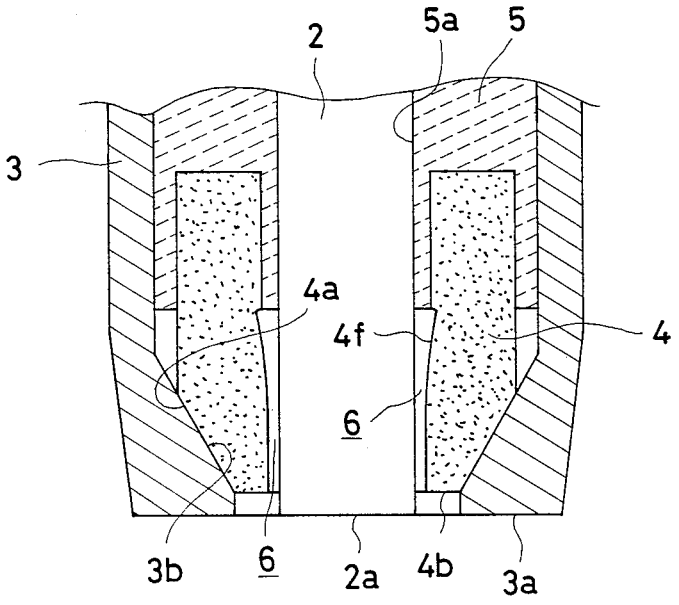

It is appreciated that the semi-conductor ring 4 has a hyperbolic curvature at its inner surface 4*f* as seen in FIG. 6.

While the invention has been described in terms of specific examples, it is to be understood that the scope of the invention is not limited thereby except as defined in the following claims.

What is claimed is:

1. A creeping discharge type igniter plug comprising:

an outer annular metallic shell having an annular ground electrode concentrically connected to a lower end thereof;

a tubular insulator having a center bore, and concentrically located within the metallic shell, to a lower end of which a semiconductor ring is axially connected;

a center electrode concentrically located within the center bore of the insulator with a lower portion of the center electrode surrounded by the semi-conductor ring (4) to form an annular space (6) between an outer surface of the center electrode (2) and an inner surface of the semi-conductor ring (4); and a lateral distance between the outer surface of the center electrode and the inner surface of the semi-conductor ring in which the annular space (6) is formed, progressively decreasing toward a lower end of the semi-conductor ring (4) to maintain the least electrical resistance at a creeping discharge path defined from a lower end surface (3*a*) of the ground electrode (3) to a lower end surface (2*a*) of the center electrode (2) via a lower end surface (4*b*) of the semi-conductor ring (4) when a voltage is applied across the center (2) and ground electrode (3).

2. A creeping discharge type igniter plug as recited in claim 1, wherein the center electrode (2) at its lower part in which the semi-conductor ring (4) surrounds, is tapered progressively thereby increasing the outer diameter of the center electrode (2) toward the lower end surface (2*a*) of the center electrode (2) to establish the lateral distance relationship at the annular space (6) between the outer surface of the center electrode (2) and the inner surface of the semi-conductor ring (4).

3. A creeping discharge type igniter plug as recited in claim 1, wherein the semi-conductor ring (4) at its inner surface in which the semi-conductor ring (4) surrounds the center electrode (2), is tapered to progressively decrease an inner diameter of the ring (4) toward the lower end surface (2*a*) of the center electrode (2) to establish the lateral distance relationship at the annular space (6) between the outer surface of the center electrode (2) and the inner surface of the semi-conductor ring (4).

4. A creeping discharge type igniter plug as recited in claim 1, wherein the semi-conductor ring (4) at its inner surface in which the semi-conductor ring (4) surrounds the center electrode (2), is tapered in a hyperboloid curvature to progressively decrease an inner diameter of the ring (4) toward the lower end surface (2*a*) of the center electrode (2) to establish the lateral distance relationship at the annular space (6) between the outer surface of the center electrode (2) and the inner surface of the semi-conductor ring (4).

5. A creeping discharge type igniter plug as recited in claim 1, wherein the semi-conductor ring (4) is a sintered mixture of alumina and silicon carbide manufactured by means of hot press procedure.

6. A creeping discharge type igniter plug as recited in claim 1, wherein the center electrode (2) and the ground electrode (3) are each made of a spark-corrosion resistant tungsten-based alloy.

* * * * *